US009145662B2

(12) United States Patent
Marchand

(10) Patent No.: US 9,145,662 B2
(45) Date of Patent: Sep. 29, 2015

(54) MECHANICAL SYSTEM COMPRISING A DEVICE FOR CONNECTION BETWEEN A WEARING PART AND THE SUPPORT THEREOF, HEAVY-CONSTRUCTION MACHINE BUCKET, AND METHOD FOR IMPLEMENTING SAID SYSTEM

(75) Inventor: Fabrice Marchand, Saint Galmier (FR)

(73) Assignee: SAFE METAL, Lyons (FR)

( * ) Notice: Subject to any disclaimer, the term of this patent is extended or adjusted under 35 U.S.C. 154(b) by 0 days.

(21) Appl. No.: 14/239,870

(22) PCT Filed: Aug. 31, 2012

(86) PCT No.: PCT/EP2012/066960

§ 371 (c)(1),
(2), (4) Date: Apr. 16, 2014

(87) PCT Pub. No.: WO2013/030335

PCT Pub. Date: Mar. 7, 2013

(65) Prior Publication Data

US 2014/0298692 A1 Oct. 9, 2014

(30) Foreign Application Priority Data

Sep. 1, 2011 (FR) ..... 11 57732

(51) Int. Cl.
*E02F 9/28* (2006.01)

(52) U.S. Cl.
CPC ..... *E02F 9/2825* (2013.01); *E02F 9/2833* (2013.01); *E02F 9/2841* (2013.01); *Y10T 29/4995* (2015.01)

(58) Field of Classification Search
USPC ..... 37/455–457
IPC ..... E02F 9/2816,9/2825, 9/2833, 9/2841
See application file for complete search history.

(56) References Cited

U.S. PATENT DOCUMENTS 4,324,057 A 4/1982 White
6,799,386 B2 * 10/2004 Robinson et al. ..... 37/452

(Continued)

FOREIGN PATENT DOCUMENTS

AU 773 435 B2 5/2004
FR 2 884 841 A1 10/2006

(Continued)

OTHER PUBLICATIONS

International Search Report, dated Nov. 28, 2012, from corresponding PCT application.

*Primary Examiner* — Gary Hartmann
(74) *Attorney, Agent, or Firm* — Young & Thompson

(57) ABSTRACT

A mechanical system (1) includes a support (10), a tooth (20) and a device (30) for interconnecting the two components. The device includes an elastic sheath (40) having an inner cavity (48) and an outer wall (44) adjustable in a housing (14) of the support, and a key (50) adjustable in the cavity. The sheath and the key can be rotated together in a fixed manner about a pivoting axis in the housing, between an insertion configuration and a locking configuration, thereby forming a coupling connection between the tooth and the support. The inner cavity extends into the sheath along an eccentric axis that is radically staggered in relation to the pivoting axis. The inner cavity is provided with elements for rotatably securing to driving elements (59) arranged on the key. A heavy-construction machine bucket including such a system, and a method for implementing such a system are also described.

12 Claims, 6 Drawing Sheets

(56) References Cited

U.S. PATENT DOCUMENTS

| | | | | |
|---|---|---|---|---|
| 6,976,325 | B2 * | 12/2005 | Robinson et al. | 37/456 |
| 7,069,676 | B2 * | 7/2006 | Robinson et al. | 37/457 |
| 7,690,137 | B2 * | 4/2010 | Pasqualini | 37/455 |
| RE41,855 | E * | 10/2010 | Ruvang et al. | 37/456 |
| 8,122,623 | B1 * | 2/2012 | Hughes | 37/457 |
| 8,468,725 | B2 * | 6/2013 | Leslie et al. | 37/456 |
| 2007/0261278 | A1 | 11/2007 | Campomanes | |
| 2008/0184603 | A1 | 8/2008 | Pasqualini | |
| 2010/0170119 | A1 * | 7/2010 | Lopez Almendros et al. | 37/452 |
| 2012/0304505 | A1 * | 12/2012 | Ruvang | 37/452 |
| 2014/0223785 | A1 * | 8/2014 | Marchand | 37/457 |
| 2014/0245645 | A1 * | 9/2014 | Marchand | 37/444 |
| 2014/0360062 | A1 * | 12/2014 | Marchand | 37/455 |

FOREIGN PATENT DOCUMENTS

| | | | |
|---|---|---|---|
| GB | 2 134 965 | A | 8/1984 |
| JP | 60 008742 | U | 1/1982 |

* cited by examiner

MECHANICAL SYSTEM COMPRISING A DEVICE FOR CONNECTION BETWEEN A WEARING PART AND THE SUPPORT THEREOF, HEAVY-CONSTRUCTION MACHINE BUCKET, AND METHOD FOR IMPLEMENTING SAID SYSTEM

The present invention relates to a mechanical system comprising a support, a wearing part and a connection device between the wearing part and its support, in particular a tooth and its support belonging to a piece of heavy-construction machine equipment. The invention also relates to a heavy-construction machine bucket comprising at least one such system. Lastly, the invention relates to a method for implementing such a system.

The invention relates to the field of heavy-construction machine equipment, in particular the buckets, hoppers or other receptacles that may scrape, remove and transport materials so that they may be evacuated from a given location to other workstations using heavy-construction machines.

In a known manner, a bucket includes a leading blade equipped with wearing parts provided for their ability to penetrate the material and protect the other elements making up the bucket. Fastened on the leading blades are support-adapters having a profile nose, while the wearing parts are teeth or shields that are positioned on the support-adapter using a precise connection. This connection is temporary so that the wearing parts can be replaced after wear.

The connection between the wearing part and its support may be done by keying. To be high-performing, the keying devices must provide a rigid connection of the elements that they join. Traditionally, the assembly and disassembly of the keyings is done by using striking tools, which create a risk of injury for operators.

Also known are keying devices that do not require the use of striking tools. In that case, special restrictive equipment is necessary, in particular to disassemble the wearing part. Furthermore, the known devices are complex to manufacture and use.

FR-A-2 884 841 describes an improved keying connection device between a wearing part and its support. The key is positioned in an elastically deformable sheath, which in turn is positioned in a housing of the support. Rotating the key causes it to be misaligned relative to its initial axis and its bearing, either in the sheath by anchoring, or against the metal parts of the wearing part and its support. By rubbing in the sheath, the key may cause wear thereof. Such a connection device is satisfactory, but may be improved, in particular in terms of ease of use and wear resistance.

AU-B-773,435 describes another connection device between a wearing part and its support. This device comprises a key and a deformable sheath positioned in a housing of the support. This sheath includes a rib positioned inside a slot of the housing, thereby preventing any rotation of the sheath in the housing. The key is positioned in an inner cavity of the sheath, with a cavity body elongated between two cams with an off-centered profile relative to the axis of the key body. The key body and the cavity of the sheath have octagonal sections. The key body can pivot in the cavity of the sheath under the action of a tool. After a 180° rotation, the cams exert a locking force in orifices of the wearing part. The key and the sheath are not jointly rotatable in the housing of the support, but rub against each other. This device is not fully satisfactory, in particular in terms of ease of use and wear resistance.

The aim of the present invention is to propose an improved connection device, making it possible to eliminate striking operations for the assembly and disassembly of the wearing parts. In particular, the invention relates to a connection device by keying that is high-performing, reliable, strong, simple and practical.

To that end, the invention relates to a mechanical system comprising a support, a wearing part and a connection device between the wearing part and its support, in particular a bucket tooth and its support that belong to a heavy-construction machine, the connection device comprising:

- a sheath made from an elastically deformable material, provided with an inner cavity and an outer wall that is adjustable in a housing of the support, and
- a key including a body elongated along a key axis, the body being adjustable in the inner cavity of the sheath.

The mechanical system is characterized in that the sheath and the key are jointly rotatable around a pivot axis in the housing of the support between:

- an insertion configuration where the key is separated from the wearing part, and
- a locked configuration where the key bears against the wearing part and the sheath bears in the housing of the support, forming a coupling connection between the wearing part and the support, and in that the inner cavity extends in the sheath along an off-centered axis radially offset relative to the pivot axis, the inner cavity being provided with elements for rotational securing with driving elements formed on the body of the key.

The invention thus makes it possible to produce a rigid connection between the wearing part, in particular a bucket tooth, and its support, with considerable simplicity and high performance levels. The key and the sheath are removable from each other in the insertion configuration and secured in the locked configuration. As a result, the connection device according to the invention is easy to manufacture and use. The mechanical system can be assembled and disassembled much more quickly and with a reduced risk of injury. For example, the elements for rotationally securing the sheath with the key are slots, while the driving elements formed on the key are ribs or fins housed in the slots. The cooperation between the sheath and the key, in particular between the slots and the fins, is done by bearing and not by friction. The lifespans of the sheath and, consequently, the connection device are improved relative to the existing devices. The reliability of the connection is improved, while costs are reduced over the long term. Advantageously, the connection device may be implemented within a mechanical system with at least seven successive wearing parts.

According to other advantageous features of the invention, considered alone or in combination:

- The housing of the support and the outer wall of the sheath have transverse sections, in a plane perpendicular to the pivot axis, that are polygonal and substantially complementary, for example pentagonal or hexagonal.
- The driving elements comprise at least one fin extending parallel and radially to the key axis from the body of the key, preferably at least three fins distributed radially around the key axis.
- The drive elements comprise an outer surface of the body of the key, the outer surface having a polygonal section in a plane perpendicular to the key axis, for example a triangular, square or rectangular section.
- The securing elements comprise at least one slot extending parallel and radially to the off-centered axis, toward the outer wall, from an edge of the inner cavity of the sheath.
- The body of the key is elongated along the key axis between a head and a foot longitudinally opposite one another, with at least the head and/or the foot able to be actuated by a tool causing the key and the sheath to rotate around a pivot axis, between the insertion configuration and the locked configuration.

The head of the key comprises a cylindrical part centered on the key axis, the cylindrical part partially protruding from the outer wall of the sheath in a direction radial to the pivot axis.

The key has a center of gravity situated on the key axis, in particular the key axis constitutes an axis of symmetry of the key.

A mistake-proofing element is formed protruding on the outer wall of the sheath, that mistake-proofing element being suitable for identifying the insertion configuration of the sheath in the housing of the support.

The sheath includes a metal insert positioned around the inner cavity, the metal insert being closer to the inner cavity and the securing elements than the outer wall of the sheath.

The invention also relates to a heavy-construction machine bucket, comprising at least one mechanical system as described above. In practice, the bucket generally comprises a series of supports each receiving a tooth, which behaves like a wearing part and is secured to its support by a connection device.

Alternatively, other heavy-construction machine equipment may also be equipped with the mechanical system according to the invention.

Lastly, the invention relates to a method for implementing a mechanical system as described above. The method is characterized in that it comprises the following steps:

a) positioning the sheath in the housing of the support, with the pivot axis and the off-centered axis of the sheath situated substantially in a median plane of the support;

b) positioning the wearing part on the support;

c) positioning the key in the inner cavity of the sheath, in the insertion configuration where the key has no contact with the wearing part;

d) pivoting the connection device by a 180° rotation around a pivot axis, from the insertion configuration to the locked configuration, with the outer wall of the sheath undergoing several successive partial elastic deformations in the housing during the rotation, e) stopping the rotation of the connection device in the locked configuration, in which the key bears against the wearing part and the sheath bears in the housing of the support, forming a coupling link between the wearing part and the support.

The invention will be better understood upon reading the following description, provided solely as an non-limiting example and done in reference to the appended drawings, in which:

FIGS. 1 to 17 show a mechanical system 1 according to the invention, equipping a heavy-construction machine bucket G.

Figure 1:
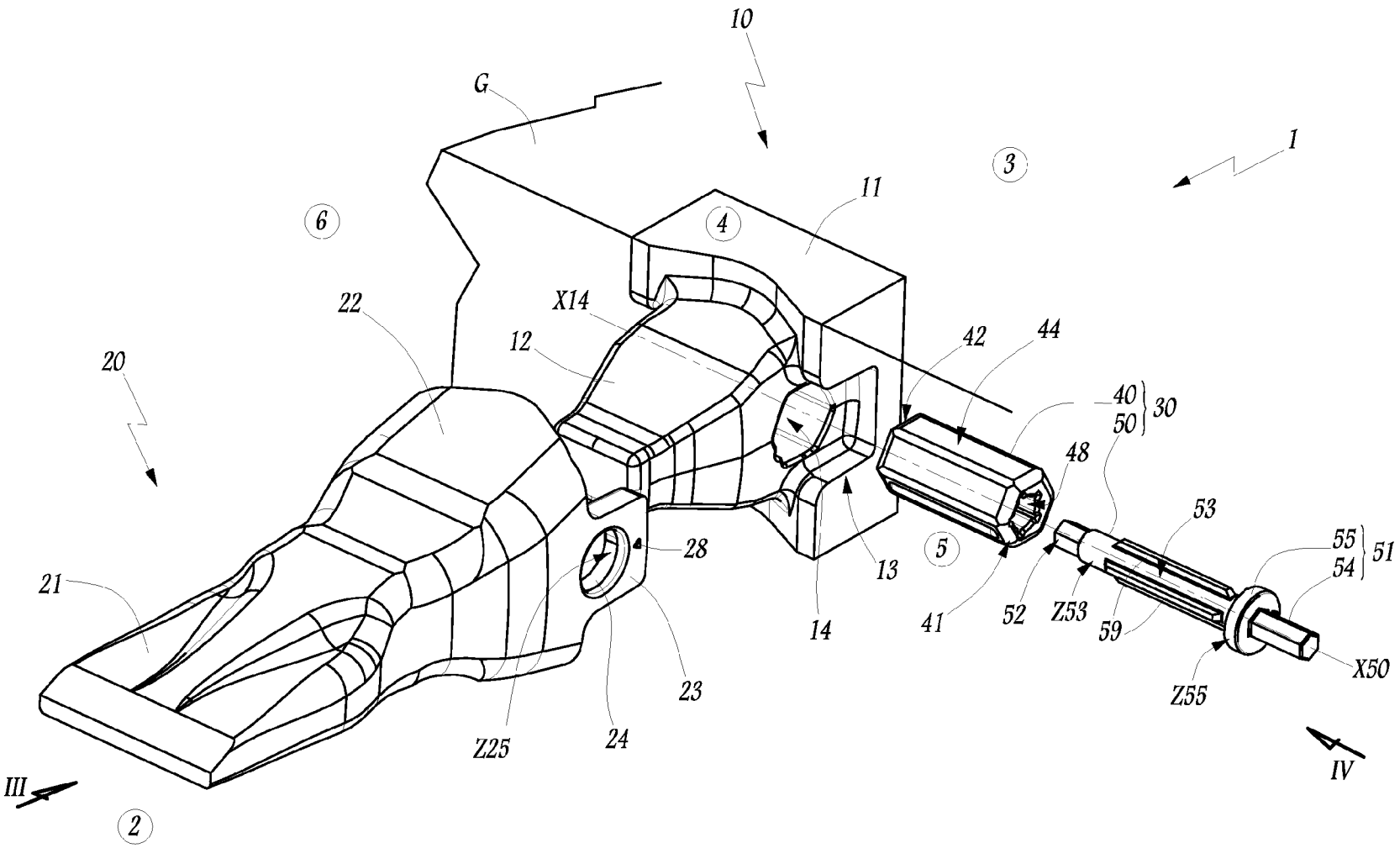
FIG. 1 is an exploded perspective view of a mechanical system according to the invention, comprising a support secured to a bucket that is partially shown, a wearing part, and a connection device for the wearing part and the support, said connection device comprising a sheath and a key.

The mechanical system 1 comprises an adapter-support 10, a wearing part 20 of the tooth type, as well as a connection device 30 between the support 10 and the tooth 20.

The bucket G is partially shown in FIG. 1, for simplification purposes. The support 10 is secured to the bucket G, while the tooth 20 is a wearing part designed to be disassembled when it is too worn by the operation of the bucket G.

The connection device 30 comprises a sheath 40 and a key 50, which are adjustable in a housing 14 of the support 10 and jointly rotatable R1 in the housing 14. The device 30 pivots between an insertion configuration A where the sheath 40 is adjusted in the housing 14 of the support 10 while the key 50 has no contact with the tooth 20 on the one hand, and a locked configuration B where the key 50 bears against the tooth 20 while the sheath 40 bears in the housing 14 of the support 10, thereby forming a coupling link between the tooth 20 and its support 10.

Figure 3:
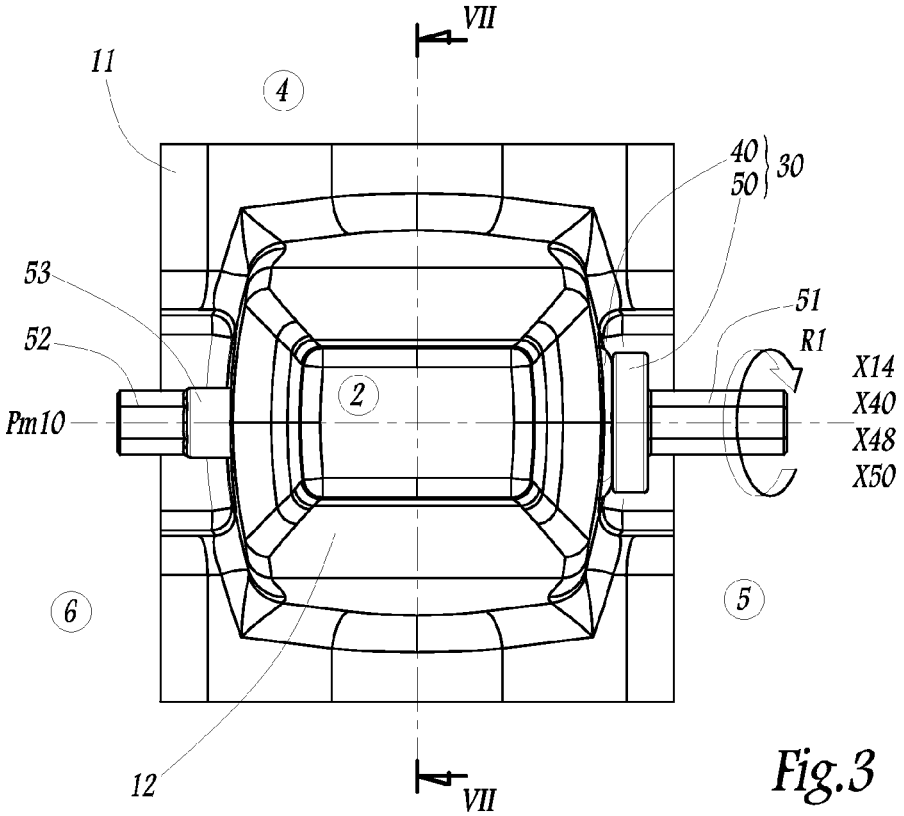
FIG. 3 is an elevation view along arrow III of FIG. 1, the wearing part not being shown.
Figure 4:
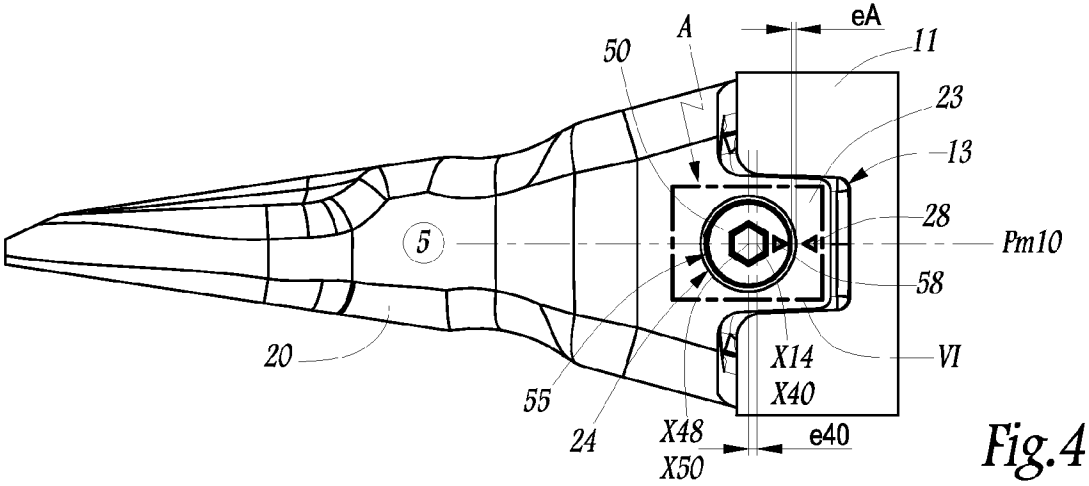
FIG. 4 is a side view along arrow IV of FIG. 1, showing the connection device in an insertion configuration.
Figure 5:
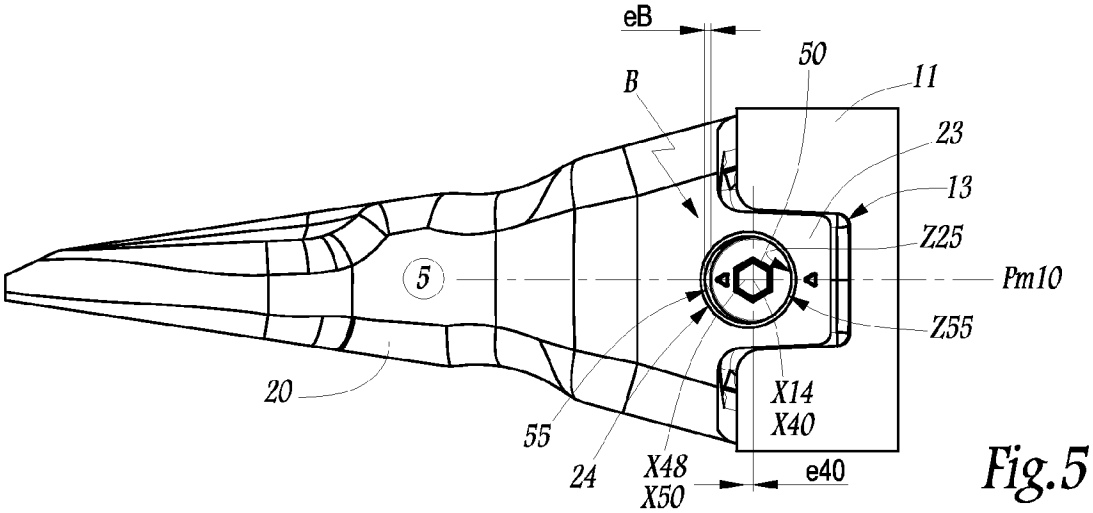
FIG. 5 is a view similar to FIG. 4, showing the connection device in a locked configuration.
Figure 6:
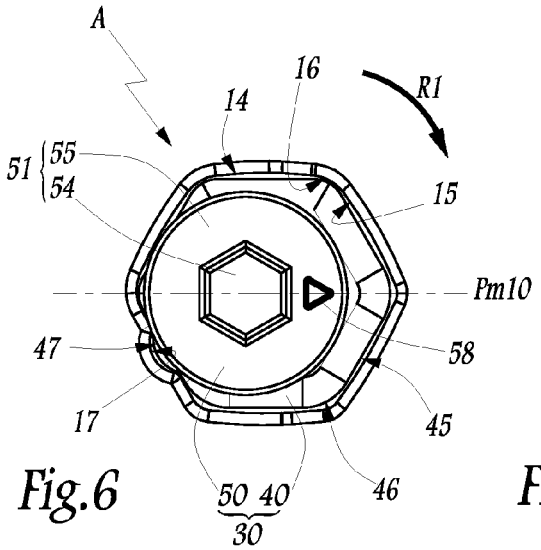
FIG. 6 is an enlarged view of detail VI in FIG. 4, showing the connection device adjusted in the support.
Figure 14:
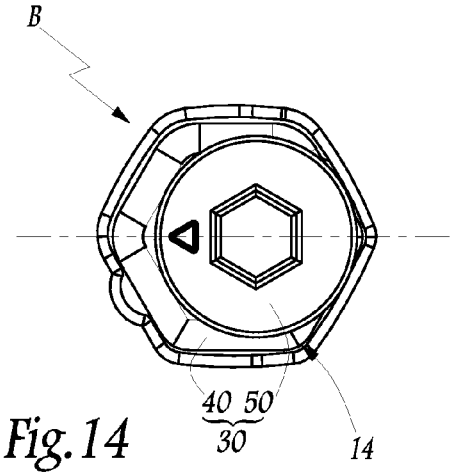
FIGS. 14 and 15 are views similar to FIGS. 6 and 7, showing the connection device in the locked configuration of FIG. 5.
Figure 15:
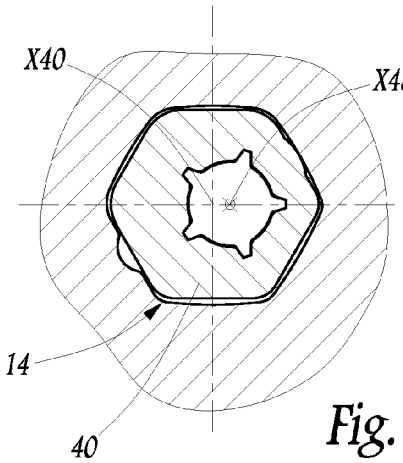

The insertion configuration A is shown in FIGS. 3, 4, 6 and 7, while the locked configuration B is shown in FIGS. 5, 14 and 15. FIG. 1 shows an assembly configuration resulting in the insertion configuration A, while FIGS. 8 to 13 show intermediate configurations between configurations A and B, while the device 30 performs a 180° rotation R1.

To facilitate the identification of the different parts of the mechanical system 1 spatially, defined are: a front side 2 at which the tooth 20 is situated, a rear side 3 at which the support 10 is situated, and an upper side 4 that is oriented opposite the ground when the system 1 is assembled, a first side 5 for insertion of the device 30 into the support 10, and a second side 6 opposite the insertion side 5.

The support 10 comprises a base 11, partially shown in FIGS. 1 to 5, as well as a fitting nose 12 provided to be engaged in a cavity of the tooth 20 configured to that end. Furthermore, a housing 13 for receiving lugs 23 of the tooth 20 is formed on each side 5 and 6 of the base 11. Each housing 13 includes walls situated toward the rear 3, the top 4 and the bottom, and is open toward the front 2 so as to receive the lugs 23. The housing 14 extends through the nose 12, along an axis X14, emerging on the sides 5 and 6. This housing 14 is framed by the housings 13 on the sides 5 and 6. The housing 14 has a polygonal section, more specifically hexagonal, in cross-section in a plane perpendicular to the axis X14. The housing 14 is defined by planar faces 15 connected by angles 16. The angles 16 are obtuse, concave and slightly rounded. A slot 17 for receiving a mistake-proofing device 47, belonging to the sheath 40, is formed parallel to the axis X14 on one of the faces 15.

The tooth 20 comprises an active part 21 situated toward the front 2 and a hollow part 22 oriented toward the rear 3. In a known manner, the part 21 is provided to scrape and remove materials, for example dirt or gravel, while the part 22 is provided for fitting of the tooth 20 on the support 10. More specifically, the part 22 comprises the inner cavity, not shown in FIGS. 1, 4 and 5, configured for fitting on the nose 12 of the support 10, as well as the lugs 23 that are oriented toward the rear and provided to be received in the housings 13, in contact with the top 4 and the bottom, as shown in FIGS. 4 and 5.

Orifices 24, each having a substantially cylindrical shape, are formed in each lug 23, on either side of the tooth 20 on the sides 5 and 6. These orifices 24 are positioned facing the housing 14 when the tooth 20 is fitted on the support 10, thereby making it possible to use the device 30 inserted in the support 10. Only the lug 23 and the orifice 24 situated on the side 5 are shown in FIGS. 1, 4 and 5. The lug situated on the side 6 is similar to the lug 23 situated on the side 5, while the orifice situated on the side 6 has a smaller diameter relative to the orifice 24 situated on the side 5. In practice, the orifices 24 are provided to receive the key 50 bearing on the tooth 20 in the locked configuration B, as described below. In particular, as shown in FIGS. 1 and 5, a bearing zone Z25 is delimited in the orifice 24 situated on the side 5. Preferably, a reference 28 is arranged on the lug 23 situated on the side 5 so as to facilitate the insertion of the key 50 in the system 1, with a specific initial position, in the insertion configuration A.

The sheath 40 is made from an elastically deformable material, for example elastomer. The sheath 40 is elongated between longitudinal ends 41 and 42 along a central axis X40, which is provided to be aligned with the axis X14 of the housing 14. In the insertion configuration A, the end 41 is situated on the side 5, while the end 42 is situated on the side 6. This distinction is made for spatial identification purposes only with the understanding that the ends 41 and 42 are reversible. The sheath 40 comprises an outer wall 44 with a polygonal section, more specifically hexagonal, in a plane perpendicular to the axis X40. The wall 44 includes planar faces 45 connected by angles 46. The angles 46 are obtuse, convex and slightly rounded. A mistake-proofing device 47 extends parallel to the axis X40 on one of the faces 45 and is provided to be received, in the insertion configuration A, in the slot 17 of the housing 14. The axis X40 is equidistant from the faces 45 and equidistant from the angles 46, such that the angle X40 can be considered to be the central axis of the wall 44. In practice, the housing 14 and the outer wall 44 have substantially complementary shapes, such that the sheath 40 can be adjusted in the housing 14 of the support 10.

Figure 2:
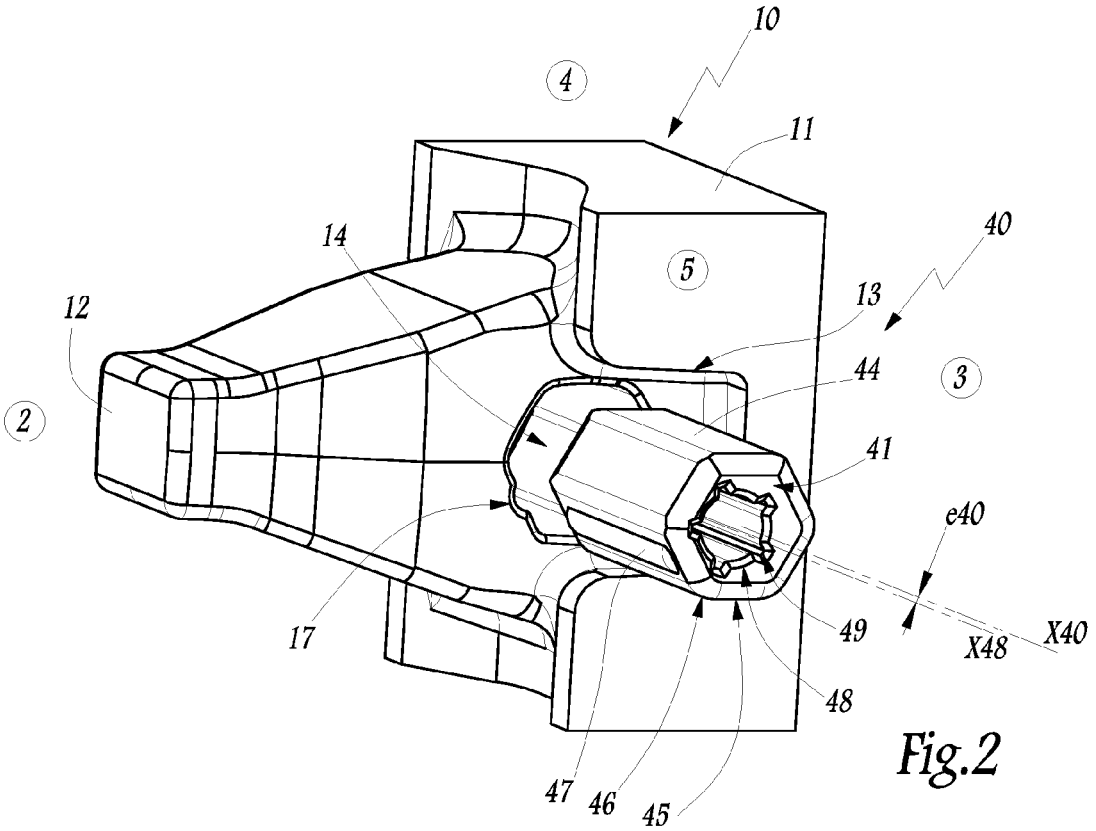
FIG. 2 is another perspective view of the system, only showing the support and the sheath.
Figure 7:
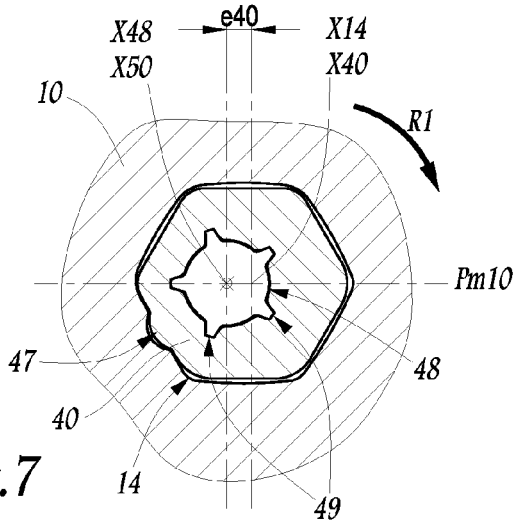
FIG. 7 is a cross-section along line VII-VII in FIG. 3, corresponding to detail VI of FIG. 6 and only showing the sheath adjusted in the support.
Figure 8:
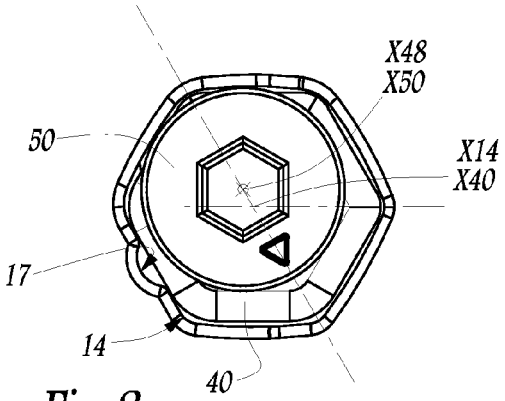
FIGS. 8, 10 and 12 are views similar to FIG. 6, showing the connection device in different intermediate configurations between the insertion configuration and the locked configuration.
Figure 9:
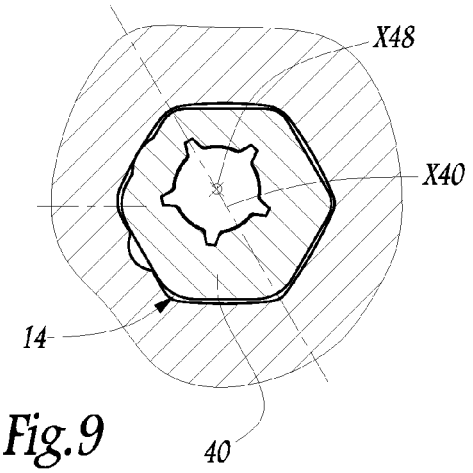
FIGS. 9, 11 and 13 are cross-sections similar to FIG. 7, showing the sheath in the intermediate configurations respectively corresponding to FIGS. 8, 10 and 12.

The sheath 40 also comprises a longitudinal inner cavity 48 that extends along an axis X48 that is off-centered relative to the axis X40. In other words, the axis X48 is an eccentric axis. The axis X48 is parallel to the axis X40, with an off-centered gap e40 formed between them in a plane perpendicular to the axis X40, as shown in FIGS. 2, 4 and 7. The sheath 40 is globally annular and closed around the axis X48. Five longitudinal slots 49 are formed in the inner cavity 48. More specifically, the slots 49 extend radially to the axis X48 from one edge of the inner cavity 48, while being parallel to the axis X48. The inner cavity 48 and the slots 49 emerge on either side of the sheath 40, along the off-centered axis X48. The slots 49 constitute elements for securing the sheath 40 in rotation R1 with the key 50.

Figure 16:
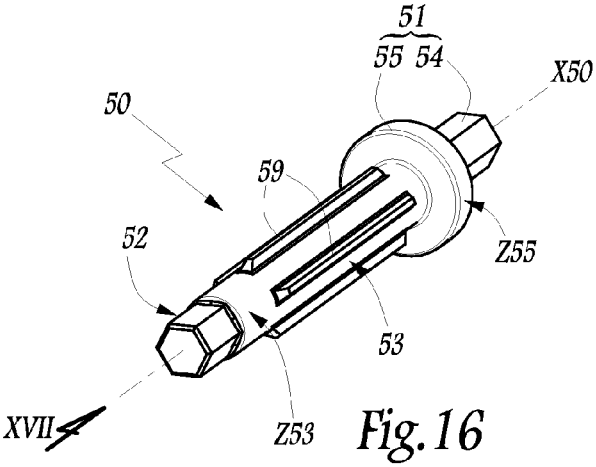
FIG. 16 is a perspective view of the key belonging to the connection device.
Figure 17:
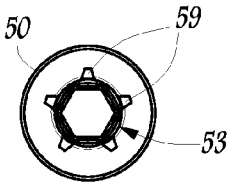
FIG. 17 is an elevation view along arrow XVII in FIG. 16.

The key 50 is made from metal, for example steel. The key 50 comprises a body 53 elongated along an axis X50 between a head 51 and a foot 52. More specifically, the head 51 comprises a hexagonal part 54 for being actuated by a tool, not shown for simplification purposes, as well as a cylindrical part 55 bearing in the orifice 24 of the tooth 20. Preferably, the foot 52 also has a hexagonal section so it can be driven by a second tool. Alternatively, the head 51 and the foot 52 can be configured differently, to be actuated by other types of tools. A reference 58 oriented on the side 5 is positioned on the part 54, so as to be positioned facing the reference 28 during insertion of the key 50 into the sheath 40 and the support 10, through the orifice 24 situated on the side 5. Ribs or fins 59 extend parallel to the axis X50 on the body 53, radially to the body 53, as shown in particular in FIGS. 1 and 16. The fins 59 constitute elements for rotating R1 the sheath 40 using the key 50. The fins 59 extend over the majority of the body 53, so as to engage with a large contact surface against the ribs 49 of the sheath 40. Advantageously, the fins 59 are distributed radially all around the key 50, for better distribution of the forces exerted in the ribs 49 during the rotation R1. The center of gravity of the key 50 is situated on the axis X50. With the exception of the part 54 and the fins 59, the key 50 is a piece of revolution around the axis X50, with no off-centered part.

The operation of the connection device 30 equipping the mechanical system 1 is described below.

In a first step a), the sheath 40 is inserted by the end 42 into the housing 14 of the support 10, with the mistake-proofing device 47 housed in the slot 17. The mistake-proofing device 47 allows indexing of the sheath 40, which allows an operator to identify its specific initial position easily. The ends 41 and 42 are reversible, such that the operator only worries about the orientation of the mistake-proofing device 47. The sheath 40 is adjusted in the housing 14, with the wall 44 slightly centripetally deforming if necessary. The faces 45 are positioned across from the faces 15, while the angles 46 are positioned across from the angles 16. Preferably, play is provided between the wall 44 and the housing 14, to facilitate the insertion of the sheath 40 in the housing 14. As a non-limiting example, based on the dimensions of the system 1, this play is approximately several tenths of millimeters or several millimeters. At this stage, the central axis X40 and the off-centered axis X48 of the sheath 40 are situated substantially in a median plane Pm10 of the support 10 containing the axis X14, as shown in FIGS. 3, 4, 6 and 7.

In a second step b), the tooth 20 is positioned on the support 10, with the active part 21 oriented so as to be able to scrape and remove materials during operation of the system 1. The hollow part 22 is fitted on the nose 12, with complementary planes bearing against each other. The lugs 23 are received in the housings 13 of the base 11. On the sides 5 and 6, the orifices 24 allow the cavity 48 and the slots 49 to appear so that the key 50 can be inserted.

Alternatively, steps a) and b) can be reversed, in the event the wall 44 of the sheath 40 is sized to be inserted in the housing 14, with or without deformation, by passing through the orifice 24 of the tooth 20. Preferably, the operator places the sheath 40 in the support 10 before fitting the tooth 20 on the support 10.

In a third step c), the key 50 is inserted into the inner cavity 48 of the sheath 40, while passing through the orifice 24 on the side 5. Unlike the sheath 40, the key 50 has a given orientation, i.e., its insertion in the cavity 48 is always done with the foot 52 going in first. The reference 58 is positioned across from the reference 28, such that subsequently, the operator can easily identify the relative position of the device 30 and the support 10 during the rotation R1. The foot 52 penetrates the cavity 48 by the end 41 and emerges from the cavity 48 at the end 42 and the fins 59 become housed in the slots 49, while the head 51 protrudes from the cavity 48 at the end 41. More specifically, the cylindrical part 55 of the key 50 is positioned in the orifice 24 of the lug 23 situated on the side 5, while the end of the body 53 and the foot 52 are positioned in the other orifice of the lug situated on the side 6. FIGS. 3 and 4 illustrate this configuration, the tooth 20 not being shown in FIG. 3 for simplification reasons.

In configuration A, the key 50 is adjusted in the sheath 40, directly in contact with the inner cavity 48, but without contact with the support 10 and the tooth 20, in particular without contact with the orifices 24. As shown in FIG. 4, a gap eA is formed radially to the axis X50 between the part 55 and the inner bore of the orifice 24 situated on the side 5. This gap eA is smaller than twice the off-centered gap e40. At this stage, the axis X50 is combined with the axis X48, while the axis X40 is combined with the axis X14. The plane Pm10 comprises the axes X14, X40, X48 and X50, which are combined or parallel to each other, as well as the gaps eA and e40. In practice, the axes X14 and X40 then constitute the pivot axes of the connection device 30 within the system 1, as described below.

In a fourth step d), the operator uses a tool to pivot the device 30 by a 180° rotation R1 around the pivot axis X40, from the insertion configuration A to the locked configuration B. The operator uses at least one tool to exert a torque around the axis X50 on the part 54 of the head 51, but can also use a tool to exert a complementary torque on the foot 52. The rotation R1 of the key 50 causes the fins 59 to bear in the slots 49, such that the sheath 40 pivots securely with the key 50. In other words, the fins 59 constitute elements for rotating the sheath 40, by acting on the slots 49 that make up elements for securing the sheath 40 in rotation with the key 50. The cooperation between the sheath 40 and the key 50, more specifically between the slots 49 and the fins 59, is done by bearing and not by friction, which increases the lifespan of the sheath 40.

Figure 10:
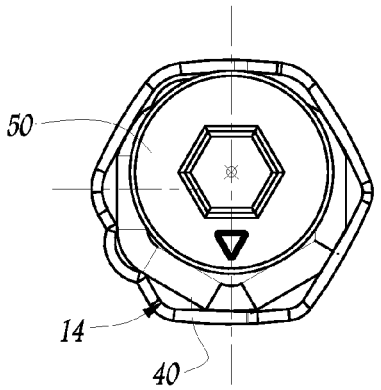
Figure 11:
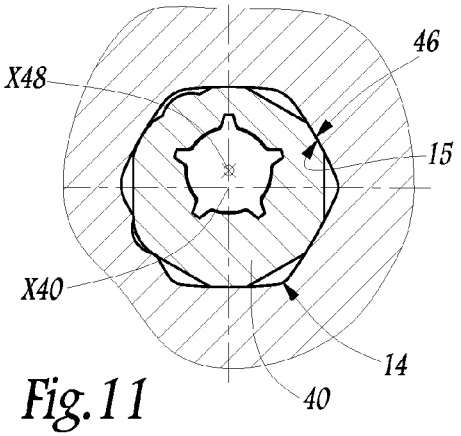
Figure 12:
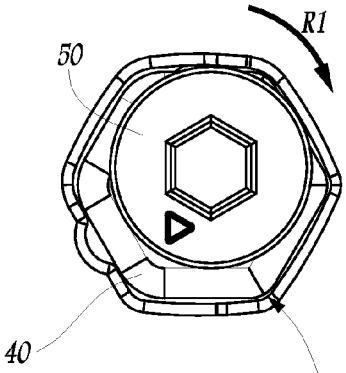
Figure 13:
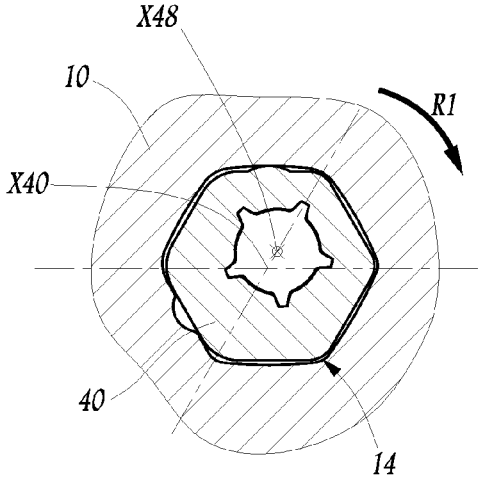

The transition from the insertion configuration A to the locked configuration B is illustrated in FIGS. 4 to 11. In particular, as shown in FIGS. 10 and 11, the outer wall 44 of the sheath 40 undergoes several successive partial elastic deformations in the housing 14 during the rotation R1. More specifically, the angles 46 deform in contact with the walls 15, at each sixth of a revolution given that the housing 14 and the wall 44 have complementary hexagonal sections. To a lesser extent, the mistake-proofing device 47 can also deform against the walls 15. The "jolts" caused by the successive deformations, localized to the angles 46, allows the operator to count the revolutions, in addition to the visual assistance provided by the references 28 and 58. Under the usage conditions of the system 1, the references 28 and 58 may be concealed by dust or dirt.

Lastly, in a fifth step e), the rotation R1 of the device 30 is stopped in the locked configuration B. The axes X14, X40, X48 and X50 remain parallel to each other, both in the insertion configuration A and in the locked configuration B, substantially in the median plane Pm10 of the support 10. During the rotation R1, the key 50 pivots by 180° around a pivot axis X40, with its axis X50 combined with the off-centered axis X48. Between its initial position and its final position, the key 50 is moved as if it had undergone a symmetry reversal relative to the pivot axis X40, as shown by comparing FIGS. 4 and 5. Furthermore, the cylindrical part 55 of the key protrudes partially from the outer wall 44 of the sheath 40, in a direction radial to the pivot axis X40. Thus, the key 50 gradually begins to bear against the tooth 40 in the second half of the rotation R1, corresponding to FIGS. 12 to 15.

In the locked configuration B, the key 50 bears against the tooth 20, while the sheath 40 bears in reaction in the housing 14 of the support 20, forming a coupling link between the tooth 20 and the support 10. More specifically, a bearing zone Z55 delimited on the part 55 of the head 51 bears against the zone Z25 of the orifice 24 situated on the side 5, while a bearing zone Z53 delimited on the body 53 bears in the orifice of the lug 23 situated on the side 6. In other words, the body 53 and the part 55 perform a bearing and pushing function, at the zones Z53 and Z55, in the orifices 24 of the tooth 20, respectively on the sides 6 and 5. A gap eB is formed in the plane Pm10 between the part 55 and the orifice 24, opposite the zones Z25 and Z55. The gap eB is approximately twice the gap eA. The key 50 bears on the tooth 20 in a first direction oriented from the front 2 toward the rear 3, while the deformable sheath 40 is crushed in the housing 14 of the support 10 in a second direction opposite the first direction, from the rear 3 toward the front 2. Owing to the complementary shapes of the housing 14 and the wall 44, an accidental rotation of the sheath 40 and therefore of the device 30 is prevented.

Thus, when mechanical forces are exerted on the active part 21, the part 22 of the tooth 20 is firmly retained in the usage position simultaneously by the connection device 30 in the locked configuration B, by the nose 12, and by the walls of the housings 13 receiving the lugs 23.

Subsequently, in a disassembly step f), the operator can use at least one tool, preferably two tools, to pivot the device 30 in a direction opposite the direction of rotation R1. The forces exerted by the device 30 on the tooth 20 and in the support 10 are released, from the locked configuration B toward the insertion configuration A. Next, the device 30 may be removed from the system 1, eliminating the coupling connection between the tooth 20 and the support 10. Thus, the device allows the tooth 20 to be disassembled without a hammer, after wearing of said tooth, through operations opposite the mounting operations.

Figure 18:
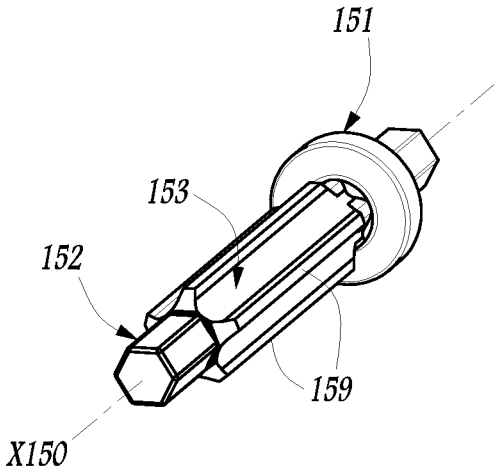
FIG. 18 is a perspective view of a key belonging to a mechanical system according to a second embodiment of the invention.
Figure 19:
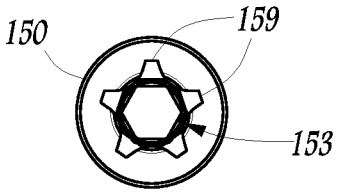
FIG. 19 is a view similar to FIG. 17 for the key of FIG. 18.

FIGS. 18 and 19 show a key 150 belonging to a second embodiment of a mechanical system according to the invention.

The key 150 comprises a body 153 that is elongated along an axis X150 between a head 151 and a foot 152 and is provided with five fins 159. The key 150 has a similar operation, but different structure, compared to the key 50 of the first embodiment. The main difference relates to the body 153 and the fins 159, which have, in cross-section in a plane perpendicular to the axis X150, a star shape with five branches. Furthermore, the transition between the fins 159 forms a concave curve. The center of gravity of the key 150 is situated on the axis X150.

Only the key 150 is shown in FIGS. 18 and 19, with the understanding that the sheath used with that key 150 has complementary shapes, in particular at the inner cavity and slots cooperating with the fins 159.

Figure 20:
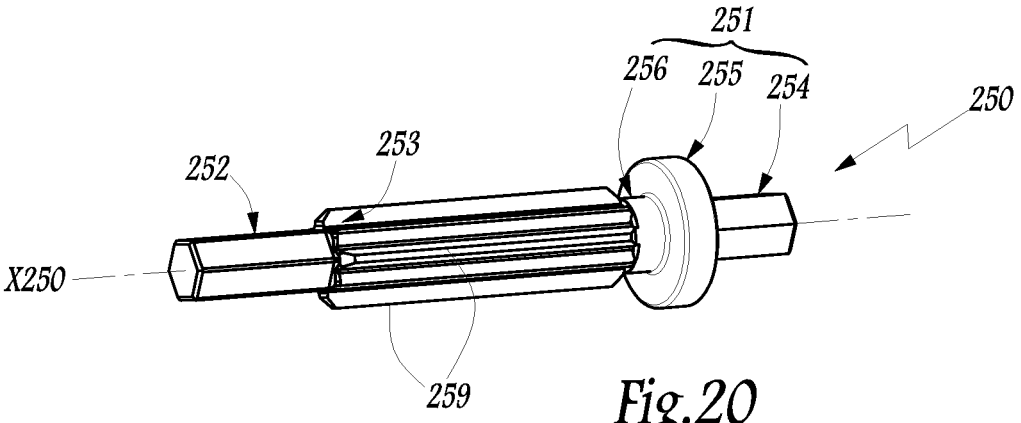
FIG. 20 is a perspective view of a key belonging to the mechanical system according to a third embodiment of the invention.
Figure 21:
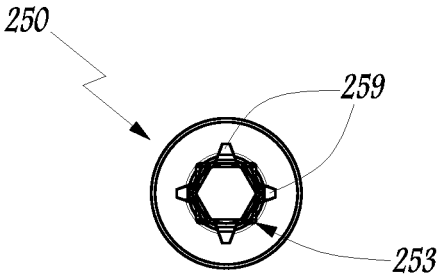
FIG. 21 is a view similar to FIG. 17 for the key of FIG. 20.

FIGS. 20 and 21 show a key 250 belonging to a third embodiment of a mechanical system according to the invention.

The key 250 comprises a body 253 that is elongated along an axis X250 between a head 251 and a foot 252 that is provided with four fins 259. The key 250 has a similar operation, but different structure, compared to the key 50 of the first embodiment. The main differences relate to the body 253 and, to a lesser extent, the head 251. In fact, the body 253 has a square and non-cylindrical section, in a plane perpendicular to the axis X250. The four fins 259 extend radially to the axis X250 from the four side faces delimiting an outer surface 257 of the parallelepiped body 253. Thus, the driving elements of the sheath that equipped that key 250 are on the one hand the fins 259 and on the other hand the outer surface 257 having a square section.

Furthermore, the head 251 comprises a hexagonal part 254, a cylindrical part 255 bearing on the tooth 20, and a cylindrical part 256 with a smaller diameter than the part 255. This part 256 produces the transition, along the axis X250, between the part 235 and the body 253, so as to simplify the manufacture of the key 250. Furthermore, the foot 252 is more elongated than the foot 52. The center of gravity of the key 250 is situated on the axis X250. More specifically, the key axis X250 constitutes an axis of symmetry of the key 250.

Only the key 250 is shown in FIGS. 20 and 21, with the understanding that the sheath used with that key 250 has complementary shapes, in particular at the inner cavity and slots cooperating with the fins 259 on the one hand in the surface 257 on the other hand.

Furthermore, the component elements of the connection device 30 may be configured differently without going beyond the scope of the invention. In particular, the key may be configured differently from the keys 50, 150 and 250, while being suitable for the present application. In practice, the key head is designed specifically to withstand the wear of the system 1 during operation, as well as to withstand several assembly and disassembly operations by a tool, while the key body cooperates with the sheath 40. The sheath 40 in turn is provided to cooperate with the housing 14 and the key, while being deformable, while having sufficient strength.

In an alternative that is not shown, the length of the key 50 along the axis X50 is such that the head 51 and the foot 52 do not protrude outside the orifices 24 of the lugs 23, when the system 1 is assembled. As shown in FIG. 3, the ends of the key 50 are then protected in the lugs 23 of the tooth 20.

According to another alternative that is not shown, the parts for using the tool to actuate the foot 52 and/or the head 51 are configured differently. For example, the part 55 may include a circular or polygonal recess, outwardly open on the side 5, facilitating the penetration of a tool.

According to another alternative that is not shown, the body of the key 50 may be provided with three fins, or more than six fins.

According to another alternative that is not shown, the outer surface 257 of the key 250 may have another polygonal section, in a plane perpendicular to the key axis X250. For example, the section of the body 253 and its surface 257 may be triangular or rectangular.

According to another alternative that is not shown, the key 250 may be provided with a body that has a polygonal section, but no fins.

According to another alternative that is not shown, the housing 14 and the wall 44 may have complementary shapes with a section other than hexagonal, for example with three, four, five sides, or more than six sides. Preferably, the housing 14 and the wall 44 comprise at least five sides, for example have pentagonal or hexagonal sections.

According to another alternative that is not shown, the housing 14 and the wall 44 may be irregular polygons, and not regular polygons.

According to another alternative that is not shown, the sheath 40 may comprise a metal insert, for example a core in the mass of elastomeric material. This metal insert is positioned around the inner cavity 48, while being closer to the inner cavity 48 and the slots 49 than the outer wall 44 of the sheath 40. The rigidity and strength of the slots 49, in the immediate vicinity of the cavity 48, as well as the sheath 40 in its entirety, are thus improved. In other words, the sheath 40 provided with a metal insert has an increased lifespan.

According to another alternative that is not shown, the wall 44 of the sheath may be arranged to facilitate its deformation during the rotation R1. For example, the wall 44 may include localized recesses, for example distributed on the faces 45, producing targeted weakening of the wall 44.

According to another alternative that is not shown, the cavity 48 and the slots 49 do not emerge at the end 42 of the sheath 40. In that case, the sheath 40 is not reversible to be inserted into the housing 14. Only the key head can bear against the tooth 20, and not the body and/or the foot of the key.

According to another alternative that is not shown, the orifices 24 formed in the lugs 23 may include reinforced shoulders and/or thermal treatments of the contact zones with the key, so as to have an increased surface hardness and facilitate locking of the key in the locked configuration of the device.

Furthermore, the technical characteristics of the different embodiments may be combined with each other in whole or in part. Thus, the connection device may be adapted in terms of cost and performance.

The invention claimed is:

1. A mechanical system (1) comprising a support (10), a wearing part (20) and a connection device (30) between the wearing part (20) and the support (10), the connection device (30) comprising:

a sheath (40) made from an elastically deformable material, provided with an inner cavity (48) and an outer wall (44) that is adjustable in a housing (14) of the support (10), and a key (50; 150; 250) including a body (53; 153; 253) elongated along a key axis (X50; X150; X250), the body being adjustable in the inner cavity of the sheath, wherein the sheath (40) and the key (50; 150; 250) are jointly rotatable (R1) around a pivot axis (X40) in the housing (14) of the support (10) between:

an insertion configuration (A) where the key (50; 150; 250) is separated from the wearing part (20), and a locked configuration (B) where the key (50; 150; 250) bears against the wearing part (20) and the sheath (40) bears in the housing (14) of the support (10), forming a coupling connection between the wearing part (20) and the support (10), and wherein the inner cavity (48) extends in the sheath (40) along an off-centered axis (X48) radially offset relative to the pivot axis (X40), the inner cavity (48) being provided with elements (49) for rotational (R1) securing with driving elements (59; 159; 257, 259) formed on the body (53; 153; 253) of the key (50; 150; 250).

2. The mechanical system (1) according to claim 1, wherein the housing (14) of the support (10) and the outer wall (44) of the sheath (40) have transverse sections, in a plane perpendicular to the pivot axis (X40), that are polygonal and complementary.

3. The mechanical system (1) according to claim 1, wherein the driving elements (59; 159; 257, 259) comprise at least one fin (59; 159; 259) extending parallel and radially to the key axis (X50; X150; X250) from the body (53; 153; 253) of the key (50; 150; 250).

4. The mechanical system (1) according to claim 1, wherein the drive elements (257, 259) comprise an outer surface (257) of the body (253) of the key (250), the outer surface (257) having a polygonal section in a plane perpendicular to the key axis (X250).

5. The mechanical system (1) according to claim 1, wherein the securing elements (49) comprise at least one slot extending parallel and radially to the off-centered axis (X48), toward the outer wall (44), from an edge of the inner cavity (48) of the sheath (40).

6. The mechanical system (1) according to claim 1, wherein the body of the key (50; 150; 250) is elongated along the key axis (X50; X150; X250) between a head (51; 151; 251) and a foot (52; 152; 252) longitudinally opposite one another, with at least the head and/or the foot able to be actuated by a tool causing the key (50; 150; 250) and the sheath (40) to rotate (R1) around a pivot axis (X40), between the insertion configuration (A) and the locked configuration (B).

7. The mechanical system (1) according to claim 1, wherein the head (51; 151; 251) of the key (50; 150; 250) comprises a cylindrical part (55; 155; 255) centered on the key axis (X50), the cylindrical part (55; 155; 255) partially protruding from the outer wall (44) of the sheath (40) in a direction radial to the pivot axis (X40).

8. The mechanical system (1) according to claim 1, wherein the key (50; 150; 250) has a center of gravity situated on the key axis (X50).

9. The mechanical system (1) according to claim 1, wherein a mistake-proofing element (47) is formed protruding on the outer wall (44) of the sheath (40), that mistake-proofing element (47) being suitable for identifying the insertion configuration (A) of the sheath (40) in the housing (14) of the support (10).

10. The mechanical system (1) according to claim 1, wherein the sheath (40) includes a metal insert positioned around the inner cavity (48), the metal insert being closer to the inner cavity (48) and the securing elements (49) than the outer wall (44) of the sheath (40).

11. A heavy-construction machine bucket (G), comprising at least one mechanical system (1) according to claim 1.

12. A method for implementing a mechanical system (1) according to claim 1, comprising the following steps:

a) positioning the sheath (40) in the housing (14) of the support (10), with the pivot axis (X40) and the off-centered axis (X48) of the sheath (40) situated in a median plane (Pm10) of the support (10);

b) positioning the wearing part (20) on the support (10);

c) positioning the key (50; 150; 250) in the inner cavity (48) of the sheath (40), in the insertion configuration (A) where the key (50; 150; 250) has no contact with the wearing part (20);

d) pivoting the connection device (30) by a 180° rotation (R1) around the pivot axis (X40), from the insertion configuration (A) to the locked configuration (B), with the outer wall (44) of the sheath (40) undergoing several successive partial elastic deformations in the housing (14) during the rotation (R1), e) stopping the rotation (R1) of the connection device (30) in the locked configuration (B), in which the key (50; 150; 250) bears against the wearing part (20) and the sheath (40) bears in the housing (14) of the support (20), forming a coupling link between the wearing part (20) and the support (10).

* * * * *